United States Patent [19]

Kosteniuk et al.

[11] Patent Number: 5,044,805

[45] Date of Patent: Sep. 3, 1991

[54] MECHANICAL PENCIL

[75] Inventors: Steve Kosteniuk, 1301 Cumberland Avenue, Saskatoon, Saskatchewan, Canada, S7H 2L9; Jean-Guy Dufour, Ville de Ste-Catherine, Canada

[73] Assignee: Steve Kosteniuk, Saskatoon, Canada

[21] Appl. No.: 507,402

[22] Filed: Apr. 11, 1990

[51] Int. Cl.[5] ..... B43K 21/06; B43K 21/22; B43K 24/04

[52] U.S. Cl. ..... 401/82; 401/83; 401/86; 401/87; 401/93

[58] Field of Search ..... 401/82, 83, 84, 65, 401/86, 87, 88, 92, 93, 94

[56] References Cited

U.S. PATENT DOCUMENTS

| | | | |
|---|---|---|---|
| Re. 25,514 | 1/1964 | Anderton . | |
| D. 172,867 | 2/1976 | Cleveland . | |
| D. 238,357 | 1/1976 | Di Carlo . | |
| D. 268,501 | 4/1983 | Kruckel et al. . | |
| D. 276,479 | 11/1984 | Mori . | |
| D. 282,378 | 1/1986 | Ohyabu et al. . | |
| 1,063,189 | 6/1913 | Dutton | 401/83 X |
| 1,757,884 | 5/1930 | Tuggle | 401/83 |
| 1,766,271 | 6/1930 | Turner . | |
| 2,043,250 | 6/1936 | Kasdan et al. . | |
| 2,174,979 | 10/1939 | Hauton . | |
| 2,259,133 | 10/1941 | Harper | 401/83 |
| 2,287,384 | 6/1942 | Martines . | |
| 2,302,203 | 11/1942 | Frink | 401/83 |
| 2,314,777 | 3/1943 | Farrington | 401/84 X |
| 2,484,555 | 10/1949 | Comstock . | |
| 2,495,342 | 1/1950 | Moore . | |
| 2,501,612 | 3/1950 | Nielsen | 401/84 |
| 2,595,001 | 4/1952 | Sams et al. . | |
| 2,604,070 | 7/1952 | Sharrow . | |
| 2,839,030 | 6/1958 | Zang . | |
| 3,037,483 | 6/1962 | Caviglione . | |
| 3,265,201 | 8/1966 | Edwards . | |
| 3,756,727 | 9/1973 | Gallagher . | |
| 3,854,824 | 12/1974 | Kamo . | |
| 3,947,133 | 3/1976 | Kageyama et al. . | |
| 4,352,579 | 10/1982 | Yi | 401/84 X |

FOREIGN PATENT DOCUMENTS

| | | | |
|---|---|---|---|
| 708399 | 4/1965 | Canada | 401/84 |
| 702484 | 4/1931 | France | 401/82 |
| 711600 | 9/1931 | France | 401/65 |
| 1102920 | 10/1955 | France | 401/82 |
| 435531 | 5/1948 | Italy | 401/84 |
| 565591 | 7/1957 | Italy | 401/84 |

*Primary Examiner*—Steven A. Bratlie

*Attorney, Agent, or Firm*—Sterne, Kessler, Goldstein & Fox

[57] ABSTRACT

A mechanical pencil made of a molded plastics material has a flat rectangular cross-section and a slot at one end thereof for passing a flat lead piece. The housing has a front wall provided with a recess and a slot extending longitudinally of the housing in the recess. A pair of toothed racks are provided longitudinally of the housing in the chamber formed therein. A gripper including a thumb-operated slider is provided on the front wall which is bowed and urged against the front wall and is connected to a toothed anchor in the chamber which in turn is adapted to engage the rack members. A pair of bifurcated fingers are connected to the anchor member and the bifurcated fingers engage the lead piece. Cam guide means provide the gripping action of the bifurcated fingers and the releasing action thereof. The gripper is advanced and retracted by depressing the bowed slider to disengage the toothed anchor from the rack member.

10 Claims, 2 Drawing Sheets

MECHANICAL PENCIL

BACKGROUND OF THE INVENTION

1. Field of the Invention

The present invention relates to a lead storage type pencil, known as a mechanical pencil, and more particularly to a so-called mechanical pencil as a carpenter's pencil.

2. Description of the Prior Art

A carpenter's pencil is peculiar in that it has a wide flat lead core, generally of rectangular cross-section, encased in a flat wooden casing. Such a pencil is more robust than a cylindrical round pencil, for use in the field, and is more useful for providing a straight line mark on a board with a carpenter's square.

Although there are any number of mechanical pencils to substitute for a round, cylindrical type pencil, there are no known commercial mechanical pencils to replace the wood-and-lead type carpenter's pencil. The prior art mechanical pencil mechanisms are generally adapted to circular cylindrical lead bits and are not easily adaptable to flat, wide rectangular bits.

U.S. Pat. No. 1,766,271, issued June 24, 1930 to H. Turner, is directed to a flat lead bit within a circular cylindrical casing with a mechanism, such as a coil spring, which requires a circular cylindrical configuration. This patent utilizes a pair of flat clamp plates as clutches for holding the lead bit in place.

There is, however, a lipstick holder, described in U.S. Pat. No. 2,043,250, issued June 9, 1936 to N. Kasdan et al, which proposes to contain and extend a lipstick of rectangular cross-section. The lipstick holder in the Kasdan et al holder includes a sliding carrier, and a spring detent cooperates with teeth on the inside of a casing and the carrier to engage the teeth at a given position. This patent does provide a mechanism which could be adapted to a mechanical carpenter's pencil. With a mechanical carpenter's pencil, however, certain problems would still exist.

It is important that the construction of the casing be as slim as possible in order that the feel to the user is similar to that of a conventional carpenter's pencil, yet the inner walls of the casing should be spaced from the lead bit so as not to break the otherwise brittle lead bit. Since it is intended that the casing be of molded plastics material, it will necessarily be at least slightly flexible, in view of the dimensions thereof. Furthermore, there exists a problem in holding the lead bit in the casing, in view of the brittleness of the lead bit, which is not contemplated in the Kasdan et al patent in view of the relative softness of lipstick.

SUMMARY OF THE INVENTION

It is an aim of the present invention to provide an improved mechanical carpenter's pencil.

It is a further aim of the present invention to provide a mechanical pencil of simple construction having easily assembled parts.

It is a further aim of the present invention to provide a mechanical carpenter's pencil with an improved lead retention and release mechanism.

A construction in accordance with the present invention comprises an elongated housing having a pair of opposed flat rectangular front and rear walls defining an elongated chamber therein. The chamber includes an elongated lead path extending axially of the elongated housing. One end of the housing defines an opening aligned with the lead path. At least a linear rack means extends parallel to and along one side of the lead path, and an elongated slot is defined in the flat front wall parallel with the lead path. A manually engageable slider is movable longitudinally on said front wall which includes a member extending through the elongated slot connected to a lead gripper means slidable in the chamber along the lead path. The lead gripper means includes anchor means for engaging the linear rack means, and spring means are associated with the slider and gripper means to retain the anchor means engaged in the rack means to prevent axial movement of the gripper means and thus the lead. Pressure exerted against the slider sufficient to overcome the spring means will disengage the anchor means from the rack means, allowing the slider and lead gripper means to slide in unison longitudinally of the housing for advancing or retracting the lead in the housing through the slot in the end thereof.

In a more specific embodiment, the slider is bowed and urges against the front wall of the housing providing the spring means.

In yet a more specific embodiment, the gripper means includes a pair of bifurcated lead gripping fingers for engaging opposite sides of the lead, and cam guide means are provided on either side of the lead path for controlling the bifurcated gripping fingers such that, in a major portion of the lead path, the fingers are guided in a lead engaging mode by the cam guide means with the fingers close together and a portion near the slot at the end of the housing where the fingers are forced to spread apart by the cam guide means, thus disengaging the lead to thus release the lead.

More specifically, it is important that the elongated lead path, which extends longitudinally of the chamber, be spaced from the inner walls of the housing defining the chamber so that the lead piece in the path is not in contact with the parallel inner walls. This construction will minimize the risks of lead breakage due to the slight flexing of the housing while in use.

In still a more specific version of the embodiment of the present invention, flat lead pieces are provided with at least a notch on either side edge near one end thereof, and the fingers include inwardly extending projections for engaging the notches on opposite side edges of the lead.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
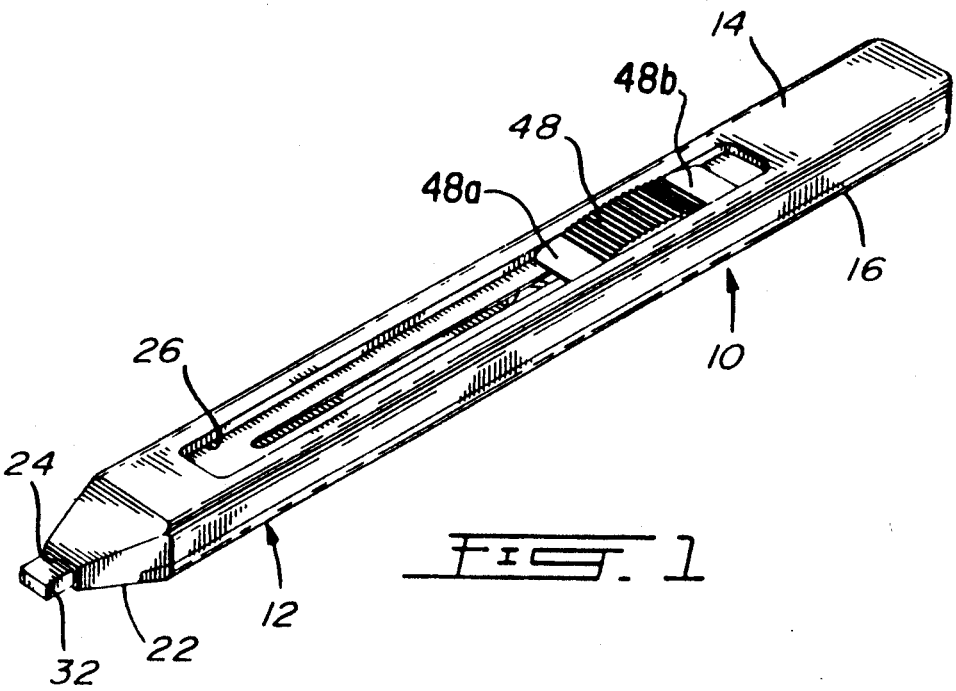
FIG. 1 is a perspective view of a mechanical pencil in accordance with the present invention.
Figure 5:
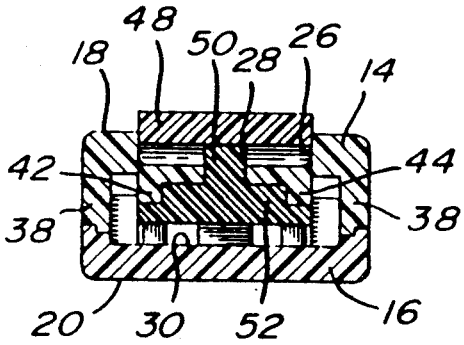
FIG. 5 is a vertical cross-section, taken along line 5—5 of FIG. 4.
Figure 6:
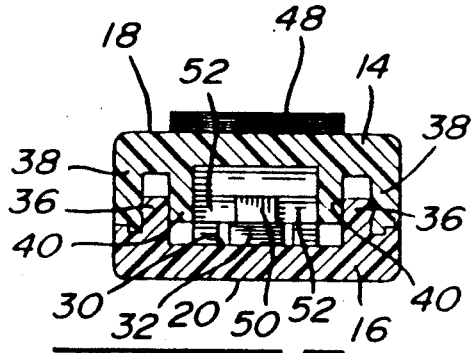
FIG. 6 is a vertical cross-section, taken along line 6—6 of FIG. 3.

The mechanical pencil 10 shown in the drawings is particularly adapted for flat lead, such as in a carpenter's pencil. The mechanical pencil includes an elongated housing 12 made up of a main housing body 14 and a lid 16 which is co-extensive therewith. The main housing body 14 and the lid 16 are molded plastics material.

Figure 2:
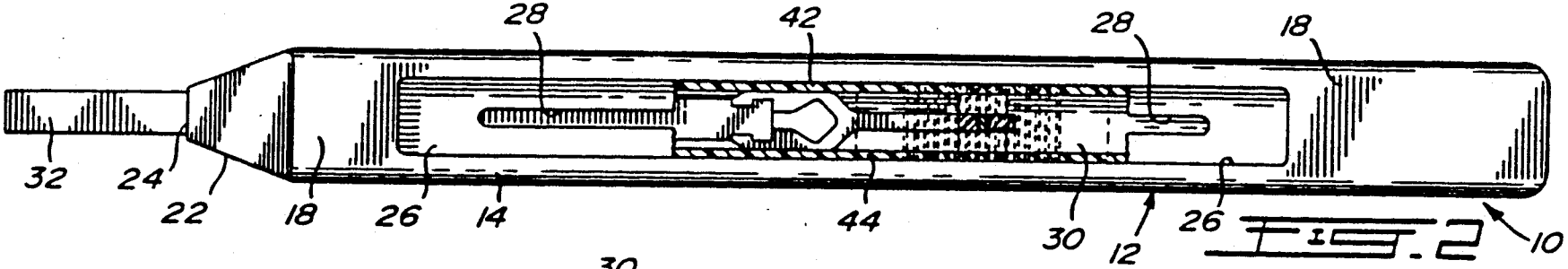
FIG. 2 is a top plan view, partly in cross-section, of the embodiment shown in FIG. 1.
Figure 4:
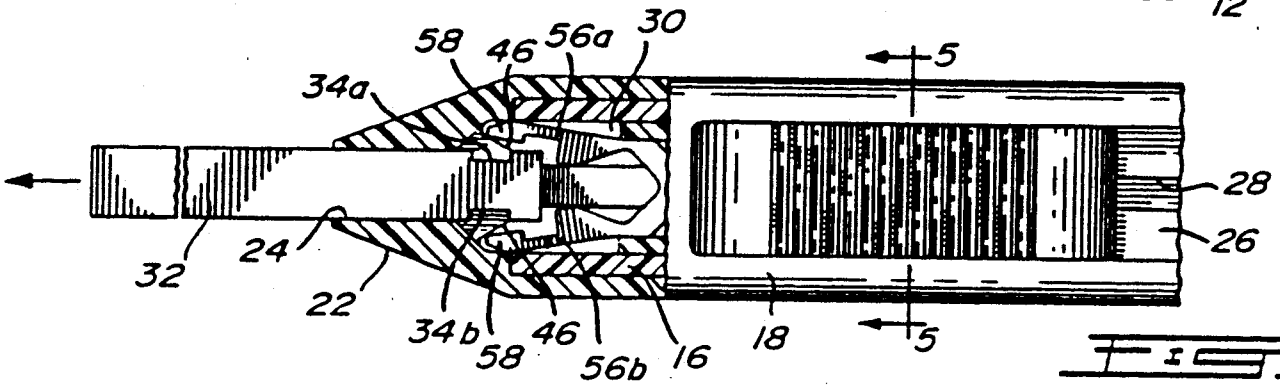
FIG. 4 is an enlarged fragmentary top plan view, partly in cross-section, of the embodiment shown in FIG. 1.

The elongated housing 12 includes a front wall 18 and a rear wall 20 of generally flat rectangular configuration. The housing terminates in a tapered tip 22 having a frusto-pyramidal configuration which in turn defines a slot 24 at the front end thereof. The elongated body 14 and lid 16 define an internal elongated chamber 30 which communicates with the slot 28, and a single piece of lead 32 of rectangular cross-section is adapted to slide in the elongated chamber along a lead path aligned with the slot 24. As shown in FIGS. 2 and 4, the lead may be provided with a pair of opposed notches 34*a* and 34*b* near one end of the piece of lead 32.

The lid 16 and main housing body 14 are provided with interconnecting flanges to allow a snap fit of the two parts to form the elongated housing 12. For instance, ribs 36 may be provided on the lid adapted to snap fit between complementary flanges 38 and 40 provided on the housing body 14.

Within the chamber 30 and molded integrally with the main body 14 is a pair of toothed racks 42 and 44 which extend axially of the body and parallel to the lead path on either side thereof. The toothed racks 42 and 44 also act as cam guides as will be described later. The toothed racks 42 and 44 extend within the chamber approximately the length of the recess 26. Between the ends of the toothed racks 42 and 44 and the tip 22 is a pair of diverting cam ramps 46 provided integrally on the lid 16.

The front wall 18 of the housing is provided with an elongated rectangular recess 26 which extends for a major part of the length thereof, and a slot 28 is provided in the recess 26. The slot 28 communicates with the elongated chamber 30.

Figure 3:
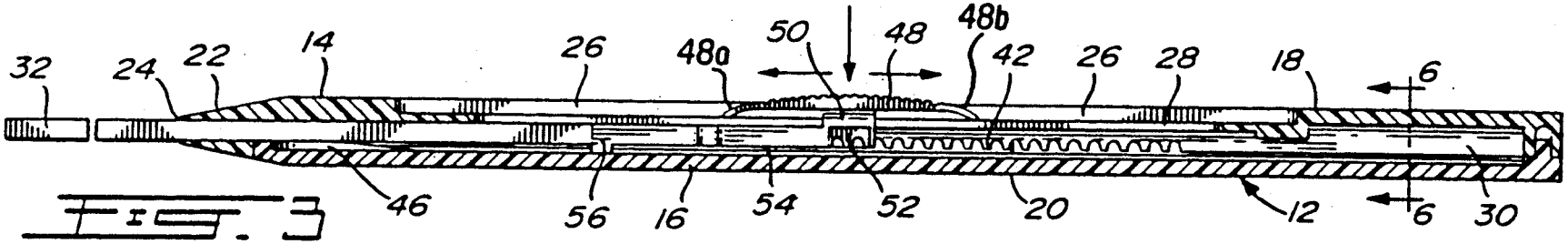
FIG. 3 is a vertical cross-section, taken axially of the mechanical pencil shown in FIGS. 1 and 2.

A slider 48 having a bowed configuration, such as shown in FIG. 3, is integrally connected to a stem 50 which extends through the slot 28. The slider 48 is made to slide in the recess 26. A toothed anchor 52 which is fixedly connected to the stem 50 is provided in the chamber 30. The toothed anchor 52 has laterally extending teeth adapted to engage the toothed racks 42 and 44. The spring action of the bowed slider 48 normally forces the teeth on the toothed anchor 52 to engage the toothed racks 42 and 44. Upon applying finger pressure on the slider 48, the toothed anchor 52 is disengaged from the toothed racks 42 and 44, allowing the slider to be moved to and fro in the recess 26. The pressure necessary to depress the slider to disengage the anchor 52 from the toothed racks 42 and 44 should be such as to minimize the possibility of accidental disengagement while in use, i.e., by a finger brushing past the slider.

The slider 48 has forward and rear portions 48*a*, 48*b* which are tapered to act as wipers in order to keep the track 26 clear from debris and sawdust.

The toothed anchor 52 includes an elongated arm 54 to which are mounted a pair of bifurcated gripping fingers 56*a* and 56*b*. Fingers 56*a* and 56*b* have inwardly extending projections 58 adapted to engage the notches 34*a* and 34*b* in the lead 32. As the slider 48, toothed anchor 52, and gripping fingers 56*a* and 56*b* are moved to and fro advancing and retracting the lead 32, the fingers are held in engagement with the notches 34*a*, 34*b* in the lead by means of the cam surfaces provided on the inner sides of the toothed racks 42 and 44. As the bifurcated fingers 56*a* and 56*b* approach the tip 22 of the housing, they become free of the cam surfaces formed by the toothed racks 42 and 44 and are forced to follow diverting cam surfaces 46, as shown in FIG. 4. This causes the projections 58 to be disengaged from the notches 34*a* and 34*b*, thus releasing the lead 32.

In operation, therefore, when a new piece of lead is to be inserted in the mechanical pencil, the lead is inserted through the slot 24 with the notches 34*a* and 34*b* at the rear of the lead, as shown in FIG. 4. Upon insertion of the lead 32, the slider 48 is depressed and retracted, thereby causing the bifurcated fingers 56*a* and 56*b* with the projections 58 to engage the notches 34*a* and 34*b* and retract the lead 32. Once the lead is retracted such that a desired length projects therefrom, as shown in FIG. 1, the pencil is ready to be used. As the lead is worn down, the slider is depressed and advanced a cog or two, and then released, allowing the teeth in the toothed anchor 52 to engage the toothed racks 42 and 44, as shown in FIG. 3.

We claim:

1. A mechanical pencil comprising an elongated housing having a pair of opposed flat rectangular front and rear walls tapering at one end and defining an opening, the walls further defining an elongated chamber having flat parallel spaced-apart surfaces therein, the chamber including an elongated lead path spaced from the surfaces for accommodating a flat graphite lead member and extending axially of the elongated housing which communicates at one end of the housing with said opening in line with the lead path; at least a linear rack means within the elongated chamber extending parallel to and along one edge of the lead path and an elongated slot defined in the flat front wall parallel with the lead path; a manually engageable slider movable longitudinally on the front wall exteriorly of the housing, the slider including a stem extending through the elongated slot and connected to a lead gripper means slidable in the elongated chamber along the lead path, the lead gripper means including anchor means for engaging the linear rack means; the slider having a bowed shape with the ends of the bow engaged against the front wall to provide spring action to retain the anchor means engaged in the rack means to prevent axial movement of the gripper means and thus the lead, whereby pressure exerted against the slider sufficient to overcome the spring action of the slider will disengage the anchor means from the rack means, allowing the slider and lead gripper means to slide in unison longitudinally of the housing for advancing or retracting the lead in the housing through the opening in the end of the housing.

2. A mechanical pencil as defined in claim 1, wherein the gripper means includes a pair of bifurcated lead gripping fingers for engaging opposite sides of the lead, and cam guide means are provided on either side of the lead path for controlling the bifurcated gripping fingers such that in a major portion of the lead path, the fingers are guided in a lead engaging mode by the cam guide means with the fingers close together, and a cam portion near the opening at the end of the housing diverts the bifurcated fingers to spread the fingers apart and thus disengaging the lead.

3. A mechanical pencil as defined in claim 2, wherein individual flat lead pieces of rectangular cross-section are provided with a notch on either side edge near one end thereof, the bifurcated fingers being provided with projections adapted to engage the notches.

4. A mechanical pencil as defined in claim 2, wherein there is an elongated toothed rack member on either side of the lead path, the inner surfaces of the rack providing the cam guide means for a major portion of the lead path.

5. A mechanical pencil as defined in claim 4, wherein the pair of rack means includes a pair of elongated ribs integrally molded with the housing and provided with a series of cogs, and the gripping means includes the anchor member with laterally extending teeth adapted to engage the cogs of the rack means, and upon pressure urged on the slider, the teeth on the anchor means are disengaged from the rack means for sliding and retracting of the gripper means.

6. A mechanical pencil as defined in claim 2, wherein the housing is made up of molded plastic material and includes an elongated body in the form of a tray and an elongated lid snap-fitted to the tray portion.

7. A mechanical pencil as defined in claim 6, wherein the elongated rack means are molded integrally with the tray portion of the body and the cam portion near one end of the housing is molded with the lid.

8. A mechanical pencil as defined in claim 1, wherein the front and rear walls defining the elongated chamber are spaced from the lead path such that, when a piece of lead is in the path, it will not be in contact with said walls in order to avoid breakage of the lead due to flexing of the elongated housing during use.

9. A mechanical pencil as defined in claim 1, wherein the slider, stem and lead gripper are integrally molded in one piece of suitable plastics material.

10. In a mechanical pencil, a lead bit comprising an elongated piece of pencil quality graphite having a rectangular cross-section and front and rear flat surfaces of rectangular outline with side walls of narrower width than the front and rear surfaces, and a pair of notches defined on opposite side walls near an end thereof adapted to be engaged by gripper means in the mechanical pencil provided with an extending and retracting gripping mechanism including a pair of bifurcated fingers having inwardly extending projections for engaging said notches in the lead.

* * * * *